US008973219B2

(12) United States Patent
Shimbara

(10) Patent No.: US 8,973,219 B2
(45) Date of Patent: Mar. 10, 2015

(54) DETACHING ROLLER APPARATUS IN A COMBING MACHINE

(71) Applicant: Kabushiki Kaisha Toyota Jidoshokki, Kariya-shi, Aichi-ken (JP)

(72) Inventor: Masami Shimbara, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 13/960,206

(22) Filed: Aug. 6, 2013

(65) Prior Publication Data

US 2014/0041157 A1 Feb. 13, 2014

(30) Foreign Application Priority Data

Aug. 9, 2012 (JP) ..... 2012-177507

(51) Int. Cl.
*D01G 19/26* (2006.01)
*D01G 19/18* (2006.01)

(52) U.S. Cl.
CPC ..... *D01G 19/26* (2013.01); *D01G 19/18* (2013.01)
USPC ..... 19/231

(58) Field of Classification Search
USPC ..... 19/231, 232
See application file for complete search history.

(56) References Cited

U.S. PATENT DOCUMENTS

| | | | | |
|---|---|---|---|---|
| 3,960,024 | A * | 6/1976 | Mori et al. | 74/52 |
| 5,014,397 | A * | 5/1991 | Katori et al. | 19/231 |
| 5,022,122 | A * | 6/1991 | Clement | 19/225 |
| 6,393,666 | B2 * | 5/2002 | Verzegnassi et al. | 19/115 R |

FOREIGN PATENT DOCUMENTS

| | | | |
|---|---|---|---|
| EP | 2 397 584 | A2 | 12/2011 |
| JP | 2012-001843 | A | 1/2012 |

* cited by examiner

*Primary Examiner* — Shaun R Hurley
(74) *Attorney, Agent, or Firm* — Sughrue Mion, PLLC

(57) ABSTRACT

A detaching roller apparatus in a combing machine includes a detaching roller and a plurality of electric motors. The detaching roller has a first end and a second end. The electric motors are connected to the detaching roller at positions adjacent to at least one of the first and second ends of the detaching roller for driving the detaching roller reversibly. The electric motors are synchronized.

3 Claims, 5 Drawing Sheets

DETACHING ROLLER APPARATUS IN A COMBING MACHINE

BACKGROUND OF THE INVENTION

The present invention relates to a detaching roller apparatus in a combing machine.

A combing machine includes a nipper device, a top comb, a combing cylinder and pairs of detaching rollers as main components. While the nipper device holds a lap drawn from a lap feed unit, the combing cylinder combs a tuft of the lap thereby to remove short fibers from the lap, thus forming a fleece.

While the nipper device is moved forward to move the fleece toward the detaching rollers, the detaching rollers are rotated reversely to pull out the previously drawn fleece so that the front end of the fleece held by the nipper device and the rear end of the previous fleece received by the detaching rollers are overlapped. Subsequently, while the detaching rollers are rotated forward to receive the following fleece from the nipper device with the previous fleece, the top comb combs the rear end of the following fleece.

The combing machine usually includes eight combing units. Each combing unit has two pairs of detaching rollers to form two rows of such detaching rollers with one pair forward and the other back. Since the detaching rollers are rotated reversibly to receive the fleece, the driving device that drives the detaching rollers is subjected to an extremely large load. In particular, when the combing machine is speeded up (or when the rotational speed of the combing cylinder is increased to 300 rpm or higher, for example) to improve the productivity, the driving device is required to develop a high torque.

Japanese Unexamined Patent Application Publication No. 2012-1843 discloses a combing machine that is intended to drive at a high speed the detaching rollers requiring a high torque. The combing machine of the Publication includes two detaching rollers. The reversible rotation of the detaching rollers is synchronized with the rocking motion of the nipper frame of the nipper device. Each detaching roller has a shaft at positions adjacent to both ends of which reversible servomotors are provided for driving the shaft. The servomotors are synchronized. The shaft of each detaching roller is driven via gear trains provided between the motor shafts of the servomotors and the shaft. Each gear train has an idler gear.

In the Publication wherein the two shafts of the two detaching rollers are driven by the four servomotors, each detaching roller is driven by double torque of the servomotors, so that the detaching rollers are driven at a high speed.

In the combing machine disclosed by the Publication, the two servomotors are provided at positions adjacent to both ends of the shaft of the detaching roller to drive the detaching roller by double torque. When the combing machine needs to be speeded up and, therefore, the driving device is required to develop a higher torque, however, there is a need to increase the size of the servomotors located at positions adjacent to both ends of the shaft of each detaching roller.

Since the driving device needs to cause the detaching rollers to repeat the alternate forward and reverse rotation, the increase in the size of the servomotors causes an increase of the inertia of the rotating detaching rollers, which calls for a larger torque. Therefore, the combing machine of the Publication cannot meet the speed requirements of the combing machine.

The present invention is directed to providing a detaching roller apparatus in a combing machine that increases the driving force for the detaching roller while preventing an increase of the inertia of the driving device.

SUMMARY OF THE INVENTION

In accordance with an aspect of the present invention, there is provided a detaching roller apparatus in a combing machine that includes a detaching roller and a plurality of electric motors. The detaching roller has a first end and a second end. The electric motors are connected to the detaching roller at positions adjacent to at least one of the first and second ends of the detaching roller for driving the detaching roller reversibly. The electric motors are synchronized.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
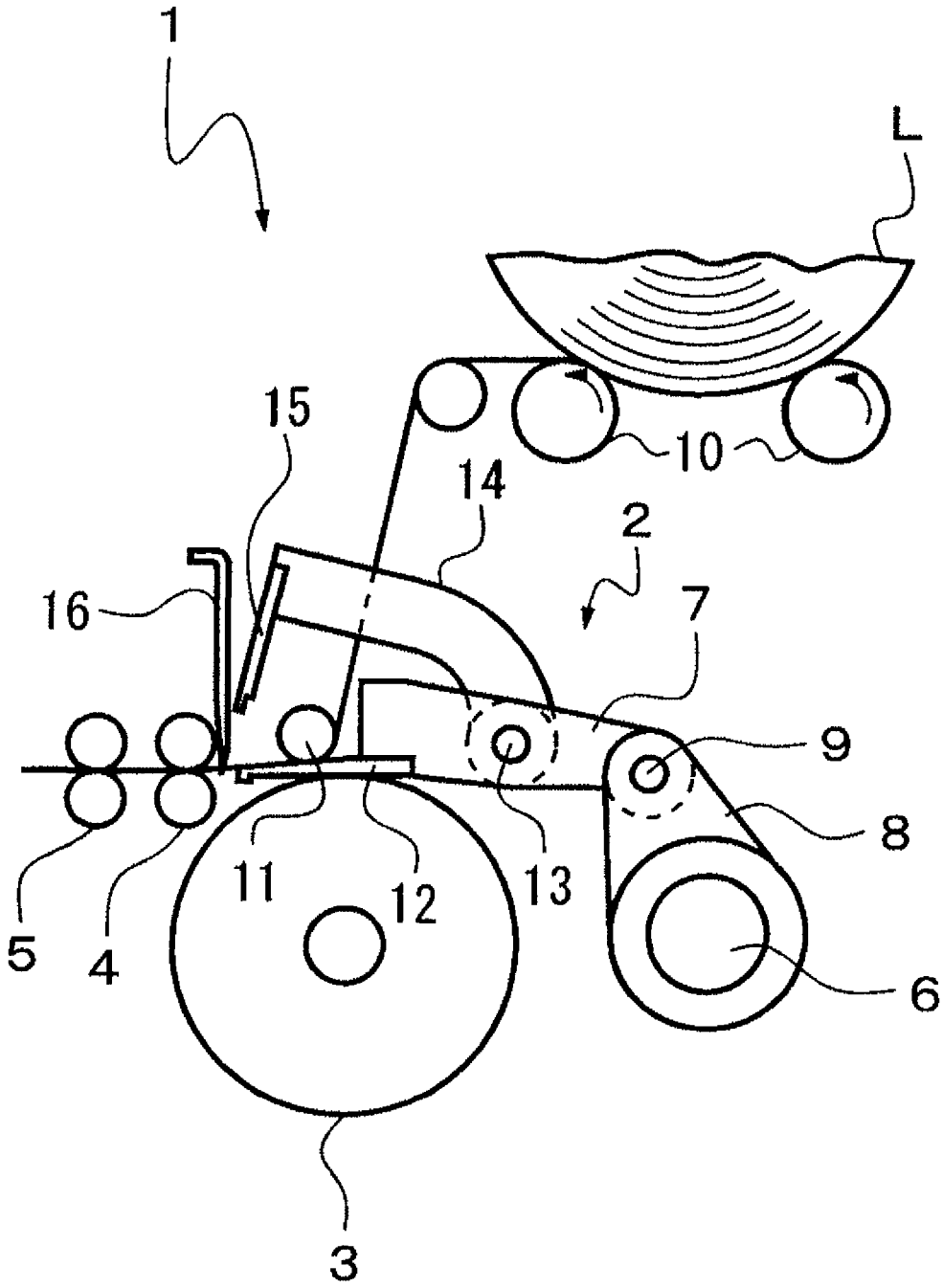
FIG. 1 is a side view showing one of combing units of a combing machine according to a first embodiment of the present invention.
Figure 2:
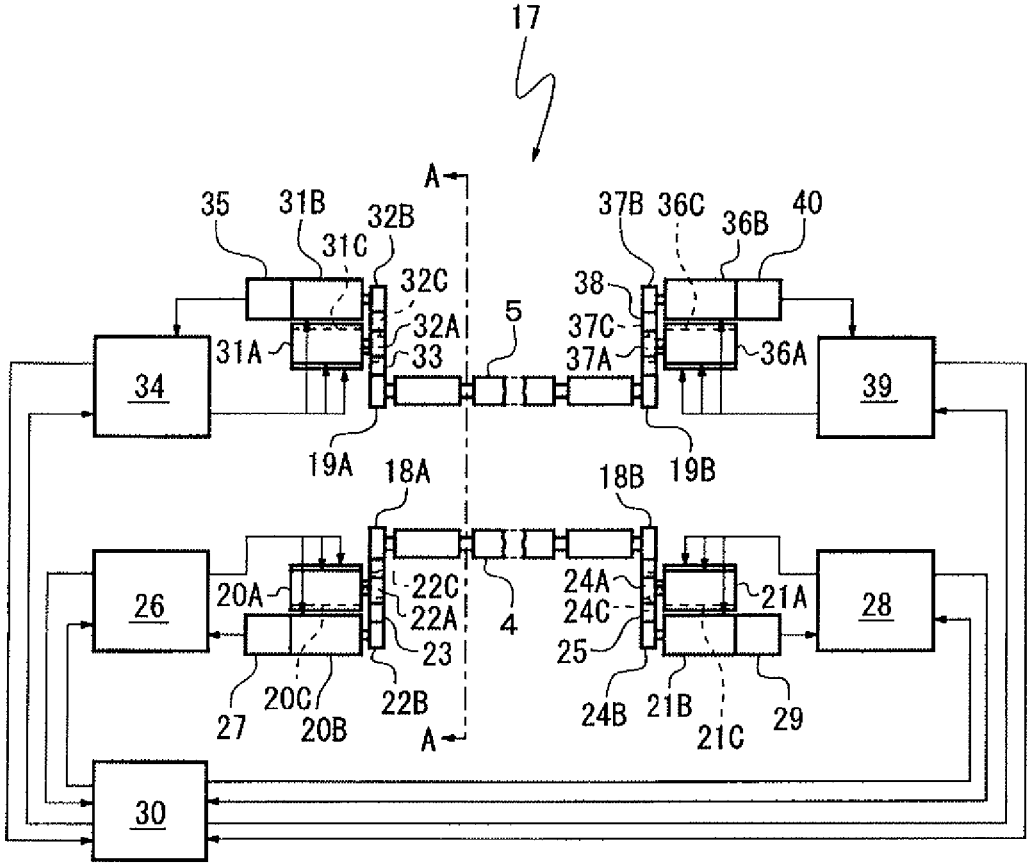
FIG. 2 is a schematic plan view showing a detaching roller apparatus of the combing machine of FIG. 1.
Figure 3:
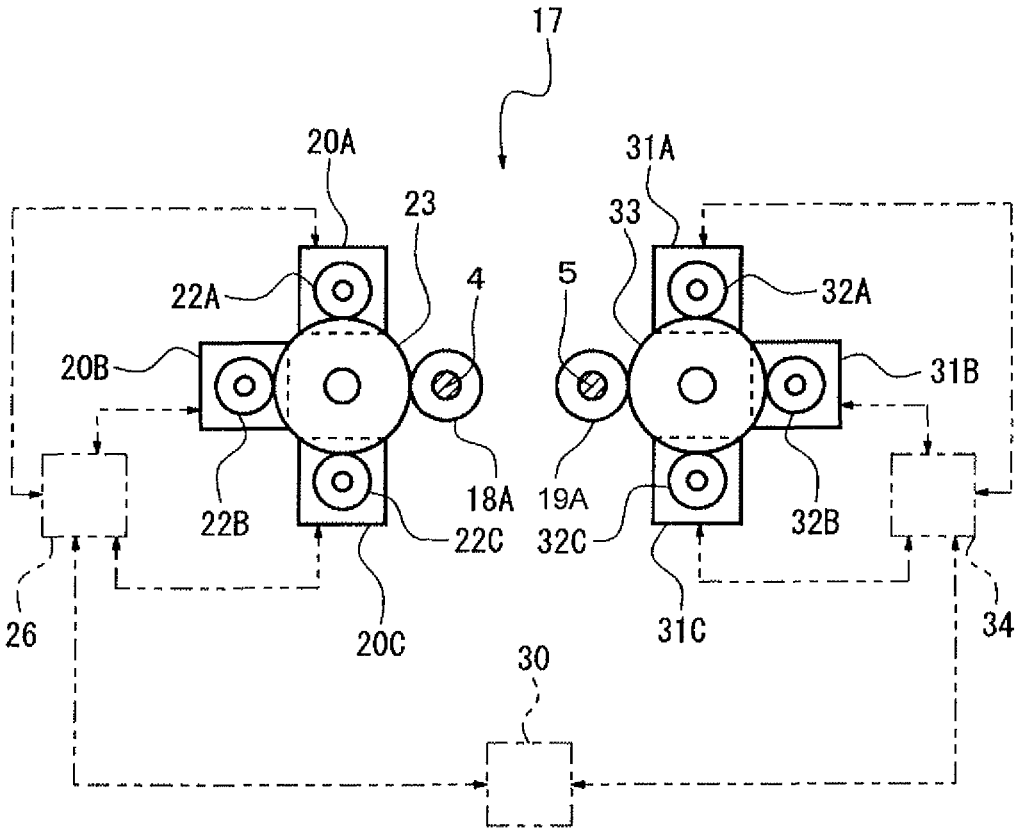
FIG. 3 is a partial cross-sectional view of the detaching roller apparatus along the line A-A of FIG. 2.

The following will describe the combing machine according to the first embodiment of the present invention with reference to FIGS. 1 through 3. It is noted that the left-hand side and the right-hand side of FIG. 1 correspond to the front and rear of the combing machine, respectively, and also that the upper side and the lower side of FIG. 1 correspond to the upper side and the lower side of the combing machine, respectively. Referring to FIG. 1, there is shown a combing unit of the combing machine which is designated by reference numeral 1. The combing machine generally includes eight such combing units 1. The combing units 1 include nipper devices 2, combing cylinders 3 and two pairs of detaching rollers 4 and 5 located forward of the combing cylinders 3. One pair of detaching rollers 4 is located rearward of the other pair of detaching rollers 5. Each pair of the detaching rollers 4 and 5 has an upper detaching roller and a lower detaching roller. Only one of the two pairs of detaching rollers 4 and 5 may be used in the combing machine.

Each nipper device 2 has a nipper shaft 6 located rearward of the corresponding combing cylinder 3 and a nipper frame 7 located above the combing cylinder 3. The nipper shaft 6 is driven to rotate reversibly by a main motor (not shown). The nipper frame 7 is connected to a drive arm 8 fixed on the nipper shaft 6 through a shaft 9 so that the nipper frame 7 is movable back and forth by the reversible rotation of the nipper shaft 6.

A pair of lap rollers 10 is located above the nipper frame 7, and a lap L is placed on the pair of lap rollers 10 to form a lap feed unit. A feed roller 11 is located forward of the nipper frame 7 for feeding the lap L to the detaching rollers 4 and 5. A bottom nipper 12 is fixed to and extends forward from the nipper frame 7. A nipper arm 14 is pivotally mounted on the shaft 13 of the nipper frame 7, and a top nipper 15 is fixed to the distal end of the nipper arm 14.

The top nipper 15 is movable at a predetermined time in synchronization with the back-and-forth movement of the nipper frame 7 thereby to hold in conjunction with the bottom nipper 12 the lap L drawn from the lap feed unit. A top comb 16 is mounted to the nipper frame 7 at a position that is forward of the bottom nipper 12 and operable to move up and down in synchronization with the back-and-forth movement of the nipper frame 7. The detaching rollers 4 and 5 are driven to rotate reversibly by a driving device 17 (refer to FIGS. 2 and 3) having dedicated motors. The detaching rollers 4, 5 and the driving device 17 cooperate to form the detaching roller apparatus of the present invention.

In the combing unit 1, the lap L fed from the lap roll by the lap rollers 10 is held at a retreated position of the nipper device 2 by the bottom nipper 12 and the top nipper 15. A tuft of the lap L is combed by the combing cylinder 3 for removal of short fibers from the lap L, thus a fleece being formed at the end of the lap L. The fleece is moved toward the detaching rollers 4 and 5 by the rocking motion of the nipper device 2. In synchronization with the rocking motion of the nipper device 2, the detaching rollers 4 and 5 are driven to rotate reversely, which moves toward the nipper device 2 the rear end of the fleece that is previously received by the detaching rollers 4 and 5.

When the forward end of the fleece held by the nipper device 2 and the rear end of the previous fleece are overlapped, the detaching rollers 4 and 5 are driven to rotate forward to receive the fleece from the nipper device 2. Thus, the fleece is moved forward with the rear end of the previous fleece being pieced to the forward end of the following fleece. The tuft of the following fleece that is moved forward is combed by the top comb 16 for removal of short fibers. The combing machine repeats the above-described combing actions. That is, the detaching rollers 4 and 5 repeat the alternate forward and reverse rotation for moving the fleece forward and reversely.

The following will describe the detaching roller apparatus with reference to FIGS. 2 and 3. The upper detaching roller 4 has gears 18A and 18B fixed at the respective first and second ends thereof. Similarly, the upper detaching roller 5 has gears 19A and 19B fixed at the respective first and second ends thereof.

The upper detaching roller 4 has at a position adjacent to the first end thereof three servomotors 20A, 20B, 20C and at a position adjacent to the second end thereof three servomotors 21A, 21B, 21C. The servomotors 20A, 20B, 20C have gears 22A, 22B, 22C fixed on the respective shafts thereof. A common idler gear 23 is meshed with the gears 22A, 22B, 22C and the gear 18A of the upper detaching roller 4. It is noted that the servomotors 20A, 20B, 20C, 21A, 21B, 21C are mounted in a frame (not shown) and the common idler gear 23 is rotatably supported in the frame (not shown).

The servomotors 21A, 21B, 21C have gears 24A, 24B, 24C fixed on the respective shafts thereof. A common idler gear 25 is meshed with the gears 24A, 24B, 24C and the gear 18B of the upper detaching roller 4. Therefore, the upper detaching roller 4 is driven by the six servomotors 20A, 20B, 20C, 21A, 21B, 21C.

The servomotors 20A, 20B, 20C are electrically connected to a servo-amplifier 26 to receive therefrom identical drive command signals. The servomotor 20B has an encoder 27 that detects the speed of the servomotor 20B and is electrically connected to the servo-amplifier 26. The encoder 27 directly detects the speed of the servomotor 20B and the detected speed represents the speed of the servomotors 20A and 20C. The encoder 27 sends the data on the speed of the servomotor 20B to the servo-amplifier 26 for feedback control. The servo-amplifier 26 sends identical drive command signals to the servomotors 20A, 20B, 20C according to the feedback signal from the encoder 27, thereby to control the rotation of the servomotors 20A, 20B, 20C.

Similarly, the servomotors 21A, 21B, 21C are electrically connected to a servo-amplifier 28 to receive therefrom identical drive command signals. The servomotor 21B has an encoder 29 that detects the speed of the servomotor 21B and is electrically connected to the servo-amplifier 28. The encoder 29 directly detects the speed of the servomotor 21B and the detected speed represents the speed of the servomotors 21A and 21C. The encoder 29 sends the data on the speed of the servomotor 21B to the servo-amplifier 28 for feedback control. The servo-amplifier 28 sends identical drive command signals to the servomotors 21A, 21B, 21C according to the feedback signal from the encoder 29, thereby to control the rotation of the servomotors 21A, 21B, 21C.

The servo-amplifiers 26 and 28 are electrically connected to a central control unit 30 located in the combing machine so as to receive therefrom synchronizing signal and forward or reverse rotation drive command signal and send drive command signals to the servomotors 20A, 20B, 20C, 21A, 21B, 21C. Thus, the upper detaching roller 4 is driven at both ends thereof to rotate forward or reversely by the servomotors 20A, 20B, 20C, 21A, 21B, 21C.

The upper detaching roller 5 has the driving mechanism that is substantially identical to the driving mechanism of the upper detaching roller 4. The upper detaching roller 5 has at a position adjacent to the first end thereof three servomotors 31A, 31B, 31C and gears 32A, 32B, 32C and a common idler gear 33. The gears 32A, 32B, 32C are fixed on the respective shafts of the servomotors 31A, 31B, 31C. The common idler gear 33 is meshed with the gears 32A, 32B, 32C and the gear 19A of the upper detaching roller 5. The servomotors 31A, 31B, 31C are electrically connected to a servo-amplifier 34. An encoder 35 is connected to the servomotor 31B for detecting the speed of the servomotors 31A and 31C, as well as the servomotor 31B. The encoder 35 is electrically connected to the servo-amplifier 34.

The upper detaching roller 5 has at a position adjacent to the second end thereof three servomotors 36A, 36B, 36C and gears 37A, 37B, 37C and a common idler gear 38. The gears 37A, 37B, 37C are fixed on the respective shafts of the servomotors 36A, 36B, 36C. The common idler gear 38 is meshed with the gears 37A, 37B, 37C and the gear 19B of the upper detaching roller 5. The servomotors 36A, 36B, 36C are electrically connected to a servo-amplifier 39. An encoder 40 is connected to the servomotor 36B for detecting the speed of the servomotors 36A and 36C, as well as the servomotor 36B. The encoder 40 is electrically connected to the servo-amplifier 39.

The servo-amplifiers 34 and 39 are electrically connected to the central control unit 30 so as to receive therefrom synchronizing signal and the forward or reverse rotation drive command signal. Thus, the upper detaching roller 5 is driven at both ends thereof by the servomotors 31A, 31B, 31C, 36A, 36B, 36C to rotate forward or reversely in synchronization with the upper detaching roller 4.

In the first embodiment wherein the upper detaching roller 4 has at a position adjacent to the first end thereof three servomotors 20A, 20B, 20C, each of the servomotors 20A, 20B, 20C is reduced in size to about one third as compared to the high-torque and large-size servomotor used in the background art. That is, the first embodiment makes it possible to use a motor having a rotor of a reduced size. In addition, the torques developed by the respective servomotors 20A, 20B, 20C are combined together thereby to provide a relatively large force. Thus, the inertia developed by the rotor of the motor produced when the upper detaching roller 4 is rotated forward and reversely alternately is reduced thereby to considerably reduce the energy necessary for driving the servomotors 20A, 20B, 20C, which contributes substantially to the reduction of power consumption.

In the first embodiment wherein the upper detaching roller 4 has not only at a position adjacent to the first end thereof three servomotors 20A, 20B, 20C but also at a position adjacent to the second end thereof three servomotors 21A, 21B, 21C, the upper detaching roller 4 is driven at both ends thereof by six servomotors 20A, 20B, 20C, 21A, 21B, 21C. Thus, the servomotors develop a high torque while solving the problem with the inertia of the servomotors. Therefore, the detaching roller apparatus of the first embodiment can meet the speed requirements of the combing machine. The same functional effects are true of the upper detaching roller 5.

Though not shown specifically in the drawing, each of the servomotors 20A, 20B, 20C, 21A, 21B, 21C, 31A, 31B, 31C, 36A, 36B, 36C uses a liquid-cooled motor to reduce the thermal effects among the servomotors that drive the upper detaching rollers 4 and 5 having large loads.

In the first embodiment, one servo-amplifier 26 or 28 (34 or 39) and one encoder 27 or 29 (35 or 40) are provided for the three servomotors at each end of the upper detaching rollers 4 (5). For example, one servo-amplifier 26 and one encoder 27 are provided for the servomotors 20A, 20B, 20C. Such configuration makes it easy to synchronize the servomotors 20A, 20B, 20C and also reduces the number of parts and hence the manufacturing cost.

Figure 4:
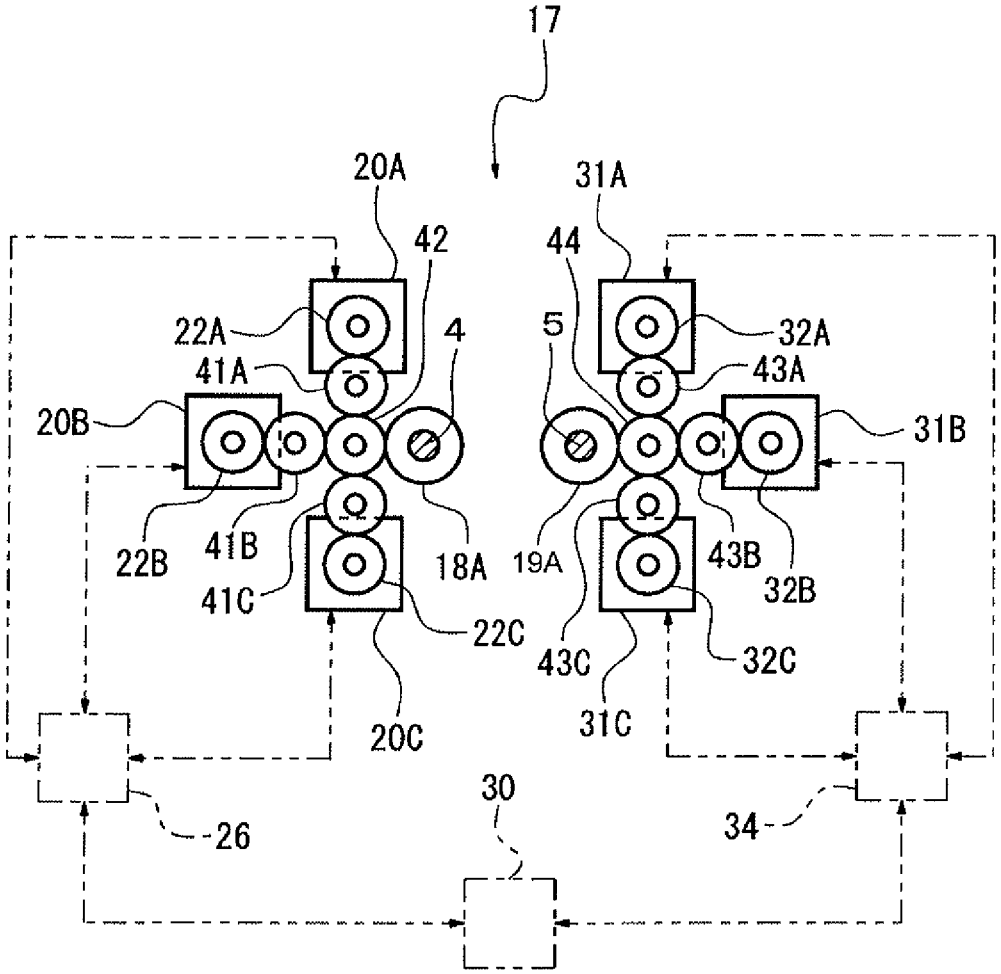
FIG. 4 is similar to FIG. 3, but shows a detaching roller apparatus of a combing machine according to a second embodiment of the present invention.

FIG. 4 shows a detaching roller apparatus of the combing machine according to the second embodiment of the present invention. In the description of the second embodiment, like reference numerals indicate like parts or elements used in the description of the first embodiment and the detailed description of such parts will be omitted. The gears 22A, 22B, 22C fixed on the shafts of the servomotors 20A, 20B, 20C at a position adjacent to the first end of the upper detaching roller 4 are meshed with individual idler gears 41A, 41B, 41C, respectively. The idler gears 41A, 41B, 41C are meshed with a common idler gear 42 that is in turn meshed with the gear 18A at the first end of the upper detaching roller 4. Although not shown in the drawing, an identical driving mechanism is provided at the second end of the same upper detaching roller 4.

The gears 32A, 32B, 32C fixed on the shafts of the servomotors 31A, 31B, 31C at a position adjacent to the first end of the upper detaching roller 5 are meshed with individual idler gears 43A, 43B, 43C, respectively. The idler gears 43A, 43B, 43C are meshed with a common idler gear 44 that is meshed with the gear 19A at the first end of the upper detaching roller 5. Although not shown in the drawing, an identical driving mechanism is provided at the second end of the same upper detaching roller 5.

The combing machine of the second embodiment has substantially the same functional effects as that of the first embodiment. In the second embodiment wherein a plurality of idler gears with a reduced diameter are used, the inertia of the connecting mechanisms between the servomotors and the upper detaching rollers 4, 5 is reduced, which contributes to the reduction of the power consumption.

Figure 5:
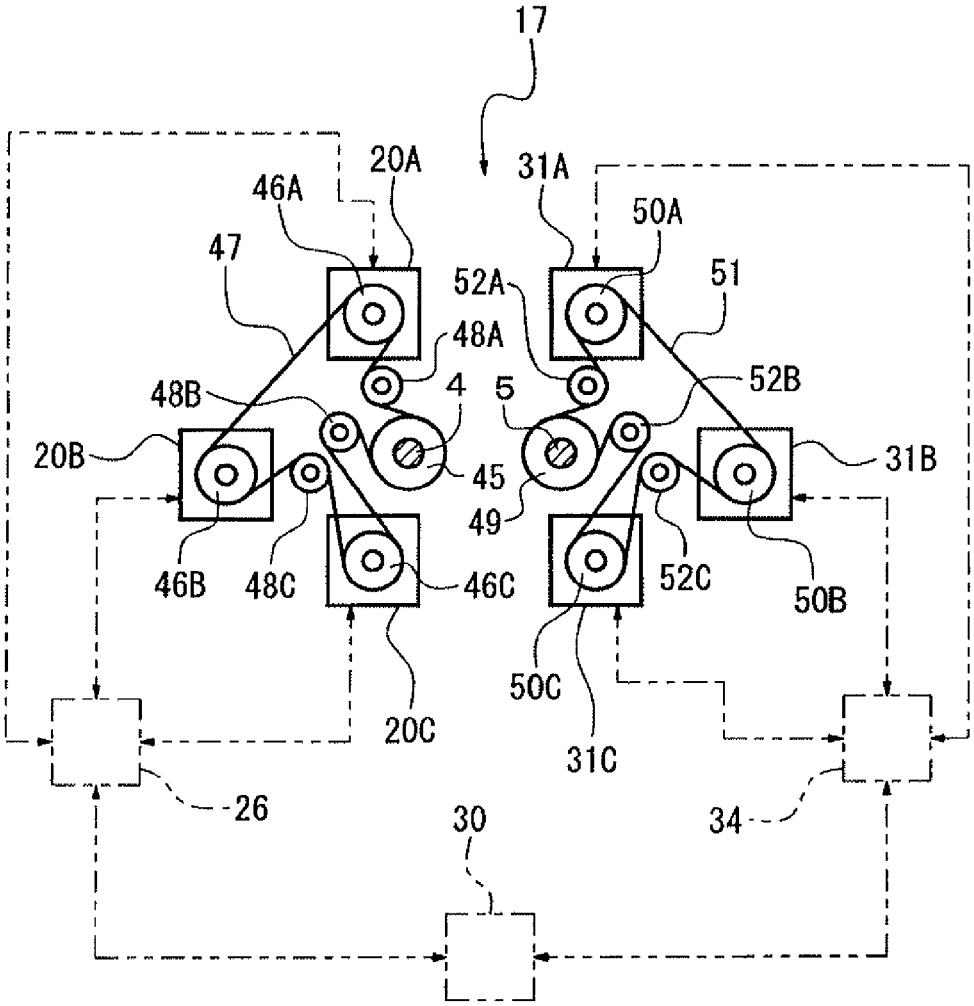
FIG. 5 is similar to FIG. 3, but shows a detaching roller apparatus of a combing machine according to a third embodiment of the present invention.

FIG. 5 shows a detaching roller apparatus of the combing machine according to the third embodiment of the present invention. In the description of the third embodiment, like reference numerals indicate like parts or elements used in the description of the first embodiment and the detailed description of such parts will be omitted. A pulley 45 is fixed at the first end of the upper detaching roller 4. Pulleys 46A, 46B, 46C are fixed on the shafts of the servomotors 20A, 20B, 20C located at positions adjacent to the first end of the upper detaching rollers 4, respectively.

A timing belt 47 is suspended among the pulleys 45, 46A, 46B, 46C under tension. Guide pulleys 48A, 48B, 48C are located between the pulleys 45 and 46A, between the pulleys 45 and 46C, and between the pulleys 46B and 46C, respectively, in contact with the timing belt 47. The guide pulleys 48A, 48B, 48C are adjustably arranged so that the guide pulleys 48A, 48B, 48C provide a predetermined tension to the timing belt 47. Although not shown in the drawing, an identical driving mechanism is provided at the second end of the upper detaching roller 4, so that the upper detaching roller 4 is driven at both ends thereof. The guide pulleys 48A, 48B, 48C are rotatably supported by a frame (not shown).

A pulley 49 is fixed at the first end of the upper detaching roller 5. Pulleys 50A, 50B, 50C are fixed on the shafts of the servomotors 31A, 31B, 31C at positions adjacent to the first end of the upper detaching roller 5, respectively. A timing belt 50 is suspended among the pulleys 49, 50A, 50B, 50C under tension.

Guide pulleys 52A, 52B, 52C are located respectively between the pulleys 49 and 50A, between the pulleys 49 and 50C, and between the pulleys 50B and 50C for providing a predetermined tension to the timing belt 51. The guide pulleys 52A, 52B, 52C are rotatably supported by a frame (not shown) and the positions of the guide pulleys 52A, 52B, 52C are adjustable to adjust the tension of the timing belt 51. Although not shown in the drawing, an identical driving mechanism is provided at the second end of the upper detaching roller 5, so that the upper detaching roller 5 is driven at both ends thereof.

The combing machine of the third embodiment has substantially the same functional effects as that of the first embodiment. In the third embodiment wherein connecting mechanisms between the servomotors and the upper detaching rollers 4, 5 are formed by the combination of the timing belt and the pulleys, the degree of freedom of layout for arranging the servomotors in the combing machine is increased.

The present invention has been described in the context of the above embodiments, but it is not limited to the embodiments. It is obvious to those skilled in the art that the invention may be practiced in various manners as exemplified below.

In the detaching roller apparatus, the number of servomotors located at positions adjacent to each end of the detaching roller 4 (5) is not limited to three as described in the first through third embodiments, but may be two or more than three.

In the detaching roller apparatus, the servomotors may be located only at positions adjacent to either one of the first and second ends of the detaching roller 4 (5).

The motors that drive the detaching rollers 4 and 5 are not limited to the servomotors, but may use any other reversible motors.

What is claimed is:

1. A detaching roller apparatus in a combing machine, comprising:

a detaching roller having a first end and a second end;

a plurality of first servomotors connected at positions adjacent to the first end of the detaching roller for driving the detaching roller reversibly; and a plurality of second servomotors connected at positions adjacent to the second end of the detaching roller for driving the detaching roller reversibly, wherein the first servomotors and the second servomotors are synchronized.

2. The detaching roller apparatus according to claim 1, wherein one of the first servomotors has a first encoder and one of the second servomotors has a second encoder, wherein the first servomotors are connected to a first servo-amplifier and the second servomotors are connected to a second servo-amplifier, wherein the first servo-amplifier controls rotation of the first servomotors according to a signal from the first encoder, wherein the second servo-amplifier controls rotation of the second servomotors according to a signal from the second encoder.

3. The detaching roller apparatus according to claim 1, wherein each of the first and second servomotors is a liquid-cooled motor.

* * * * *